US006183377B1

(12) United States Patent
Liang

(10) Patent No.: US 6,183,377 B1
(45) Date of Patent: Feb. 6, 2001

(54) METHOD FOR PRODUCING A GOLD CLUB HEAD

(76) Inventor: Lung-Cheng Liang, No. 26, Lane 82, Chung-Cheng Rd., Ta-Liao Hsiang, Kaohsiung Hsien (TW)

( * ) Notice: Under 35 U.S.C. 154(b), the term of this patent shall be extended for 0 days.

(21) Appl. No.: 09/365,535

(22) Filed: Aug. 2, 1999

(51) Int. Cl.[7] ..... A63B 53/04; B22D 19/00

(52) U.S. Cl. ..... 473/324; 473/345; 473/409; 473/346; 164/98; 164/112

(58) Field of Search ..... 473/324, 345, 473/346, 349, 350, 409, 131; 228/181, 245, 193, 194, 195; 164/112, 98

(56) References Cited

U.S. PATENT DOCUMENTS 4,930,781 * 6/1990 Allen .
5,232,224 * 8/1993 Zeider .
5,261,664 * 11/1993 Anderson .
5,485,998 * 1/1996 Kobayashi .
5,704,850 * 1/1998 Shieh .
5,753,170 * 5/1998 Muang .
5,839,975 * 11/1998 Lundberg .

* cited by examiner

*Primary Examiner*—Sebastiano Passantiti
(74) *Attorney, Agent, or Firm*—Ladas & Parry

(57) ABSTRACT

A method for producing a golf club head includes: preparing a plurality of face plates that complement with one another to form the golf club head; joining edges of the face plates to form a shape of the golf club head, and providing grooves which extend between the adjoining edges of the face plates and which open at an outer surface of the golf club head; and welding the adjoining edges by placing the joined face plates in a mold and by introducing a solder into the mold casting in the grooves.

6 Claims, 12 Drawing Sheets

METHOD FOR PRODUCING A GOLD CLUB HEAD

BACKGROUND OF THE INVENTION

1. Field of the Invention

This invention relates to a method for producing a golf club head, more particularly to a method for quickly producing a golf club head.

2. Description of the Related Art

Referring to FIG. 1, a conventional method for producing a golf club head is shown to comprise the steps of preparing 11, welding 12 and finishing 13. In step 11, a plurality of face plates 21 are prepared. The face plates 21 complement with one another to form a golf club head 2, as best illustrated in FIG. 2. In step 12, the face plates 21 are welded manually and are joined by means of a solder stick to form the golf club head 2. Finally, the golf club head 2 is finished by grinding an external surface thereof.

Such a conventional method suffers from the following disadvantages:

1. Because the face plates 21 are joined manually, the manufacturing speed of the golf club head 2 is relatively slow.

2. Since the material of the solder stick is usually the same as that of the golf club head 2, the solder material that can be employed to weld a golf club head of a specific material is limited.

3. Since the solder and the golf club head are made of the same material of the same color, the appearance of the golf club head is monotonous.

SUMMARY OF THE INVENTION

The object of the present invention is to provide a method for producing a golf club head that can overcome the disadvantages that are commonly associated with the aforementioned conventional method.

According to the present invention, the method for producing a golf club head comprises: preparing a plurality of face plates that complement with one another to form the golf club head; joining edges of the face plates to form a shape of the golf club head and providing grooves which extend between the adjoining edges of the face plates and which open at an outer surface of the golf club head; and welding the adjoining edges by placing the joined face plates in a mold and by introducing a solder into the mold for casting in the grooves.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
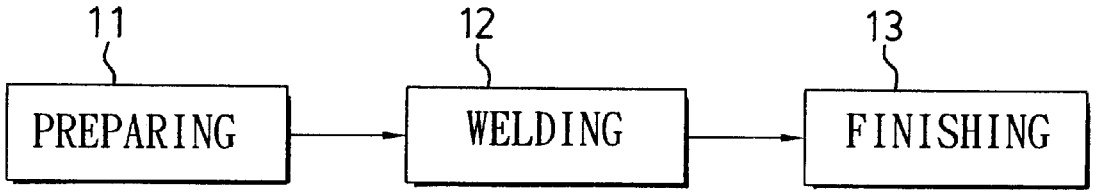
FIG. 1 PRIOR ART
FIG. 1 is a flow diagram of a conventional method for producing a golf club head.
Figure 3:
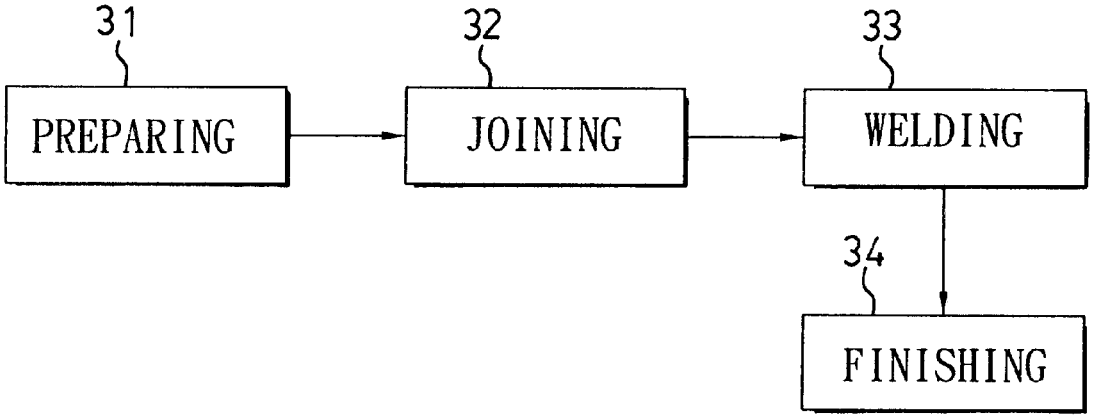
FIG. 3 is a flow diagram of a first preferred embodiment of a method for producing a golf club head according to the present invention.
Figure 2:
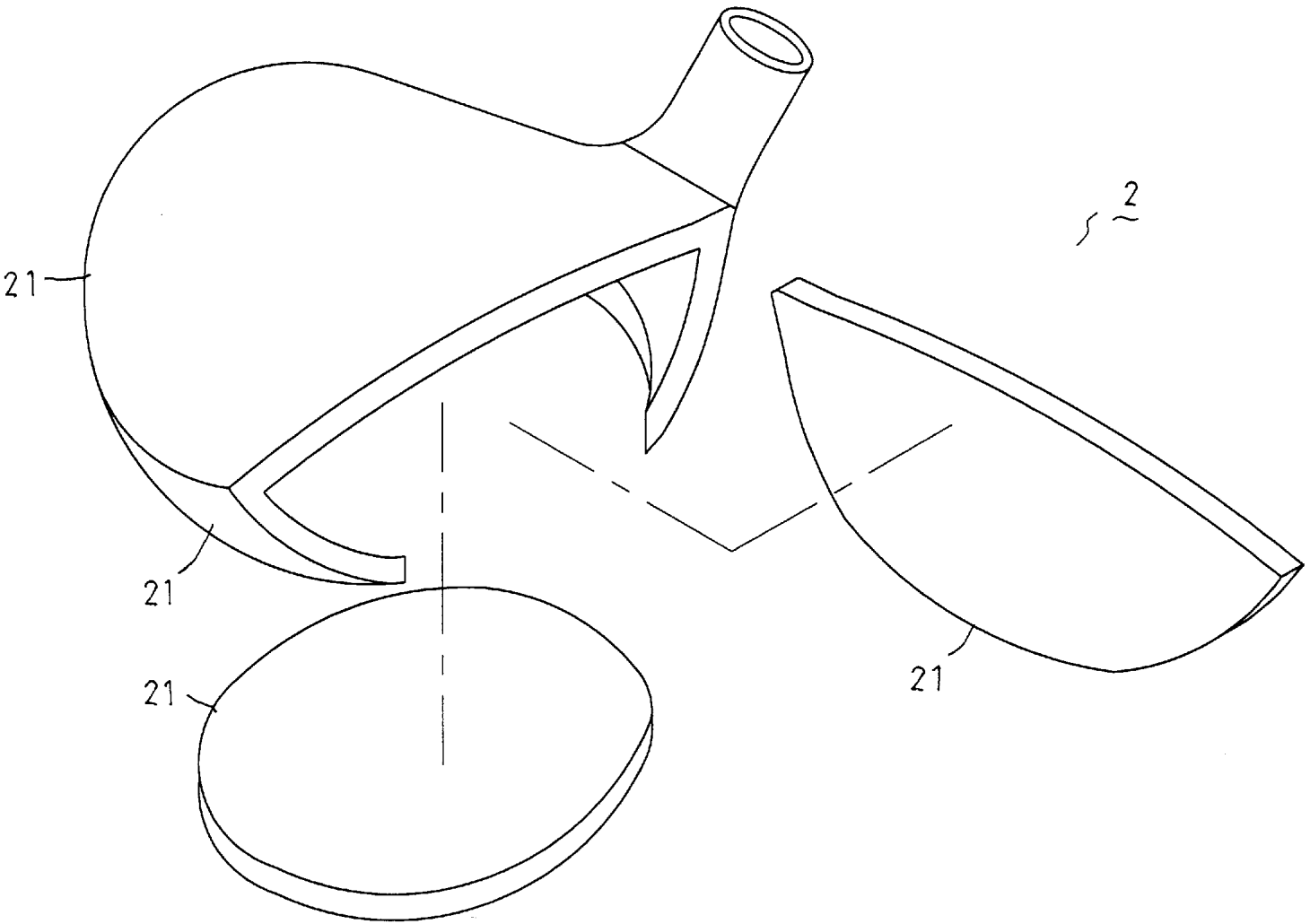
FIG. 2 PRIOR ART
FIG. 2 is an exploded view of the golf club head that is produced by the conventional method.

Referring to FIG. 3, a first preferred embodiment of a method for producing a golf club head 4 according to the present invention is shown to comprise the steps of preparing 31, joining 32, welding 33 and finishing 34.

Figure 4:
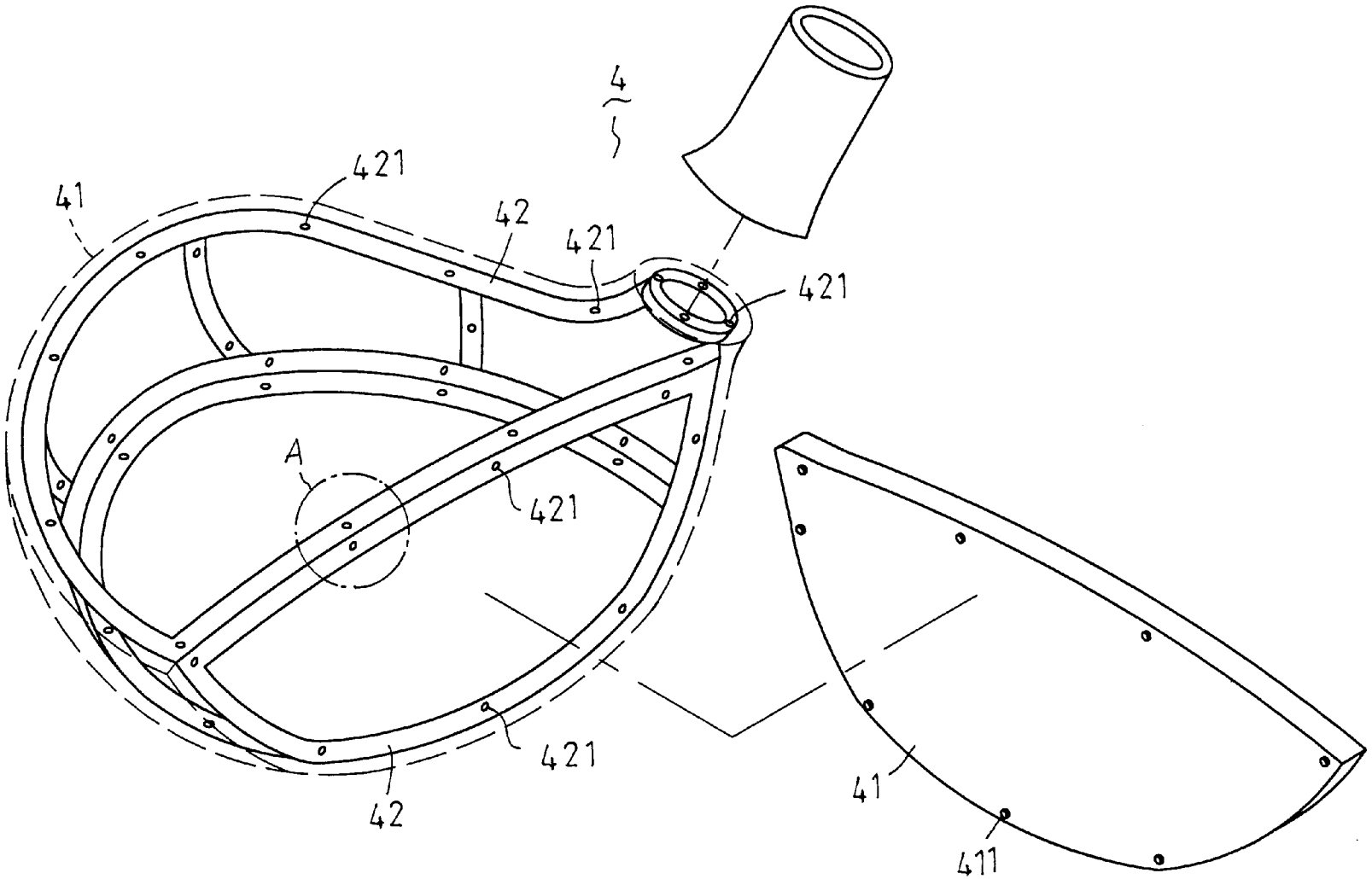
FIG. 4 is an exploded view illustrating a golf club head produced via the first preferred embodiment of the method of the present invention.

Referring to FIG. 4, a plurality of face plates 41 that complement with one another to form the golf club head 4, and a skeleton 42 that has a size smaller than that of the golf club head 4 are prepared in step 31. The skeleton 42 has a plurality of apertures 421 formed therein. Each of the face plates 41 has a plurality of pillars 411 that can engage correspondingly the apertures 421.

Figure 5:
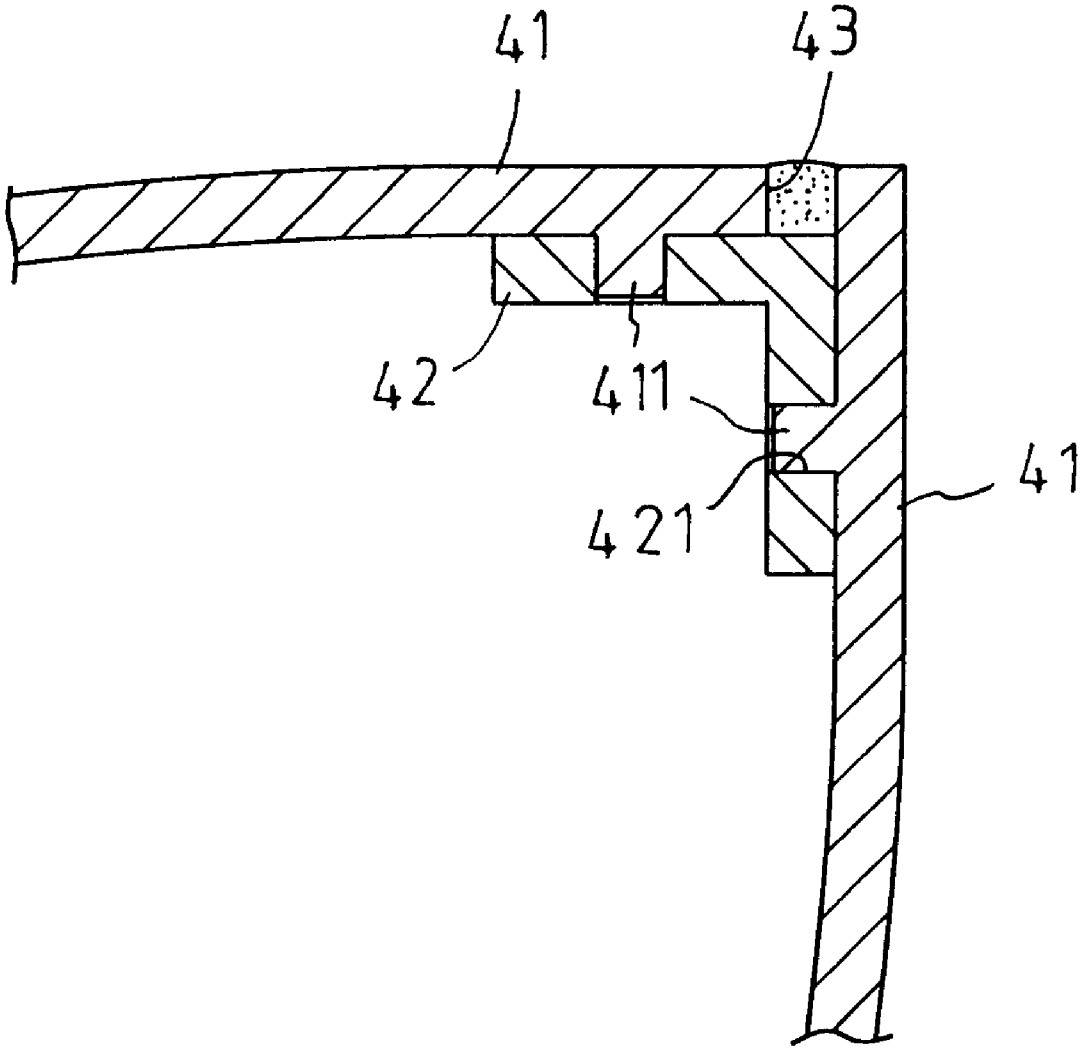
FIG. 5 is an enlarged sectional view of an encircled portion (A) shown in FIG. 4.

In step 32, the pillars 411 are inserted into the apertures 421 to position the face plates 41 on the skeleton 42. At this time, a shape of the golf club head 4 is formed, and a plurality of grooves 43 extend between the adjoining edges of the face plates 41 and open at an outer surface of the golf club head 4, as best illustrated in FIG. 5. The skeleton 42 underlies and positions the face plates 41 at the adjoining edges of the face plates 41, and spans the grooves 43 at an inner surface of the golf club head 4.

Figure 6:
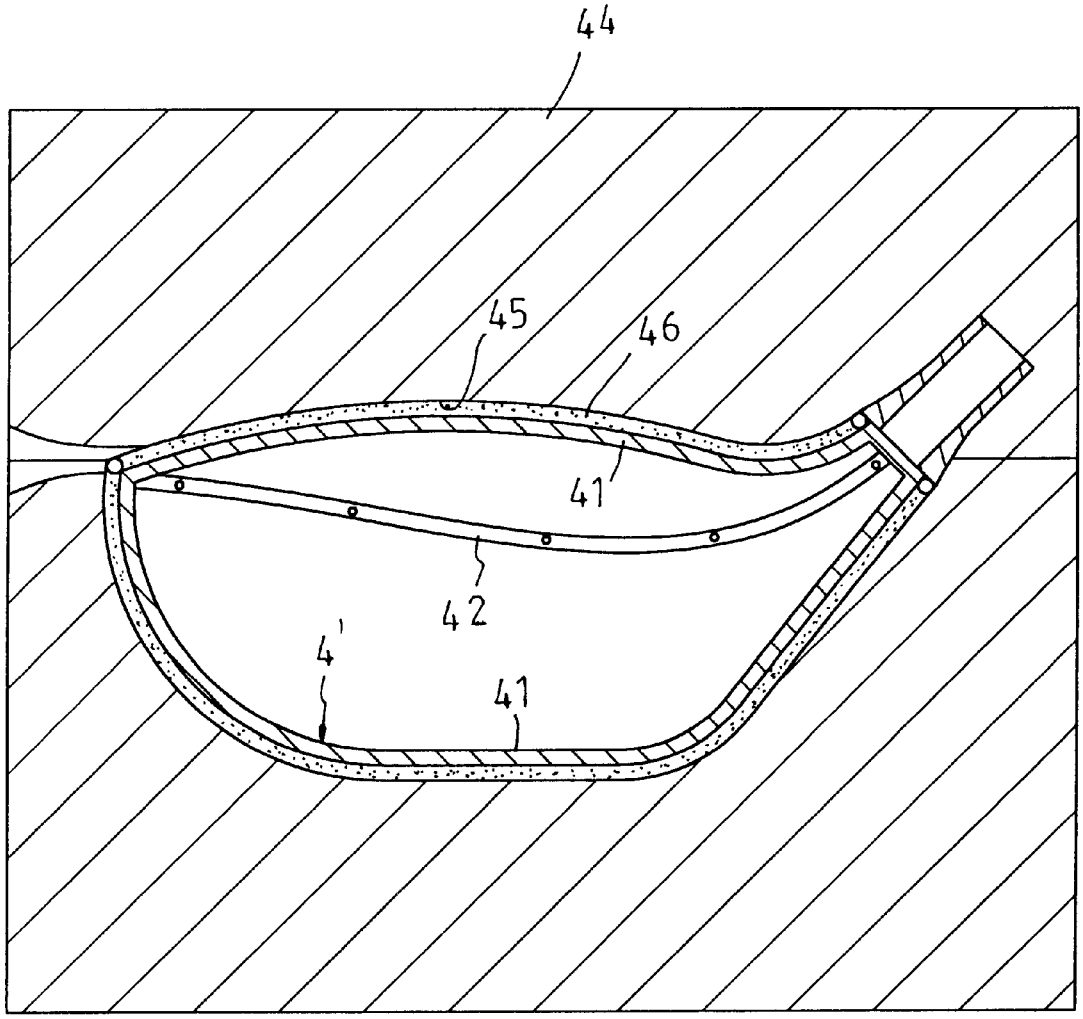
FIG. 6 is a sectional view illustrating the golf club head when undergoing welding in a mold in accordance with the first preferred embodiment of the method of the present invention.

Referring to FIG. 6, the golf club head 4 is disposed in a press-casting mold 44 that has a plurality of guiding grooves 45 that confront correspondingly the grooves 43 in step 33. A molten solder 46, such as copper, titanium and aluminum molten metal is injected into the press-casting mold 44 and flows quickly in the guiding grooves 45 to fill the grooves 43. As such, the adjoining edges of the golf club head 4 can be welded to one another after the molten solder 46 is cooled and hardened. Therefore, an integral golf club head 4' is formed.

Instep 34, the integral golf club head 4' is removed from the press-casting mold 44 and is finished by grinding an external surface thereof to remove excess hardened solder 46 on the external surface of the integral golf club head 4'.

Figure 7:
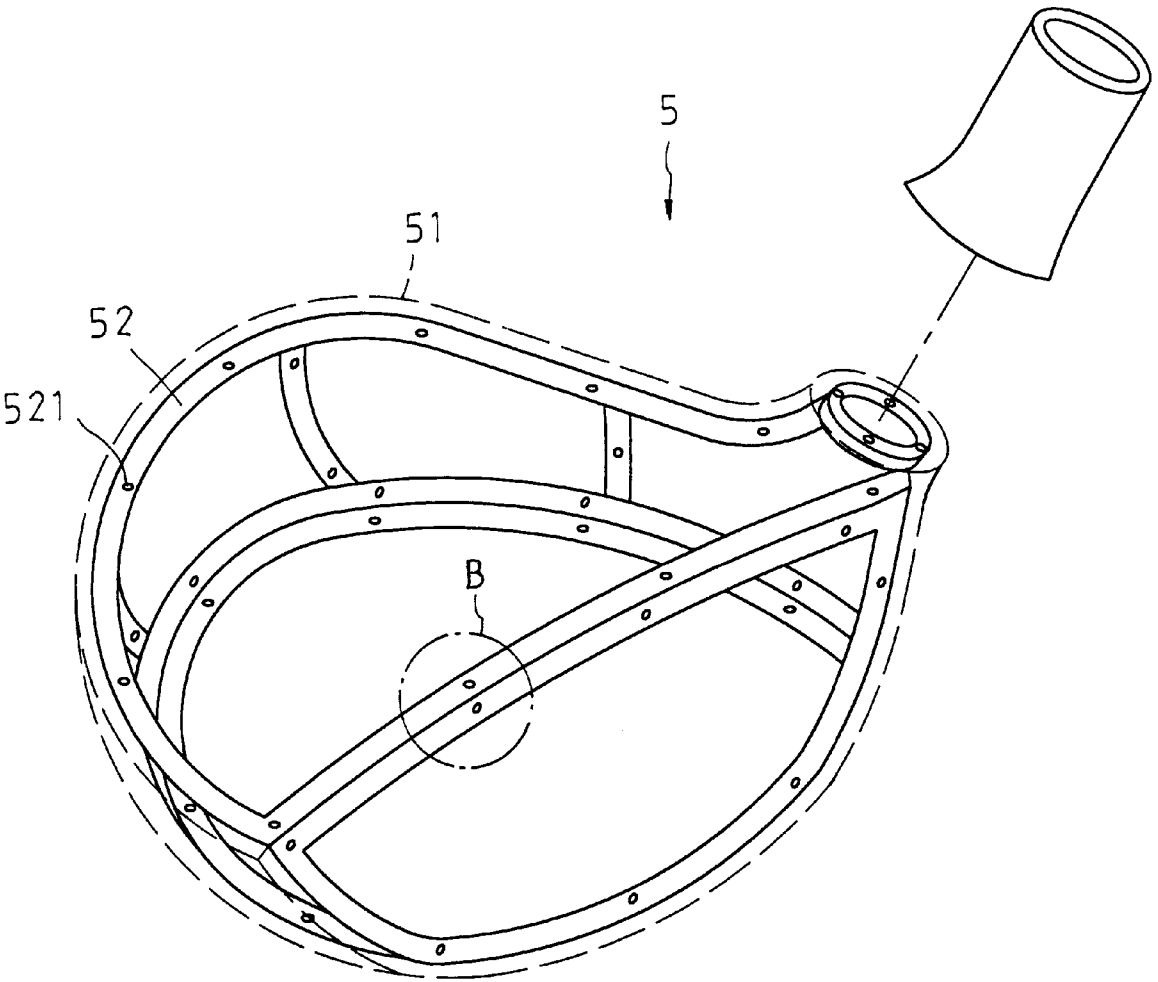
FIG. 7 is a perspective view illustrating a golf club head produced via a second preferred embodiment of the method according to the present invention.
Figure 8:
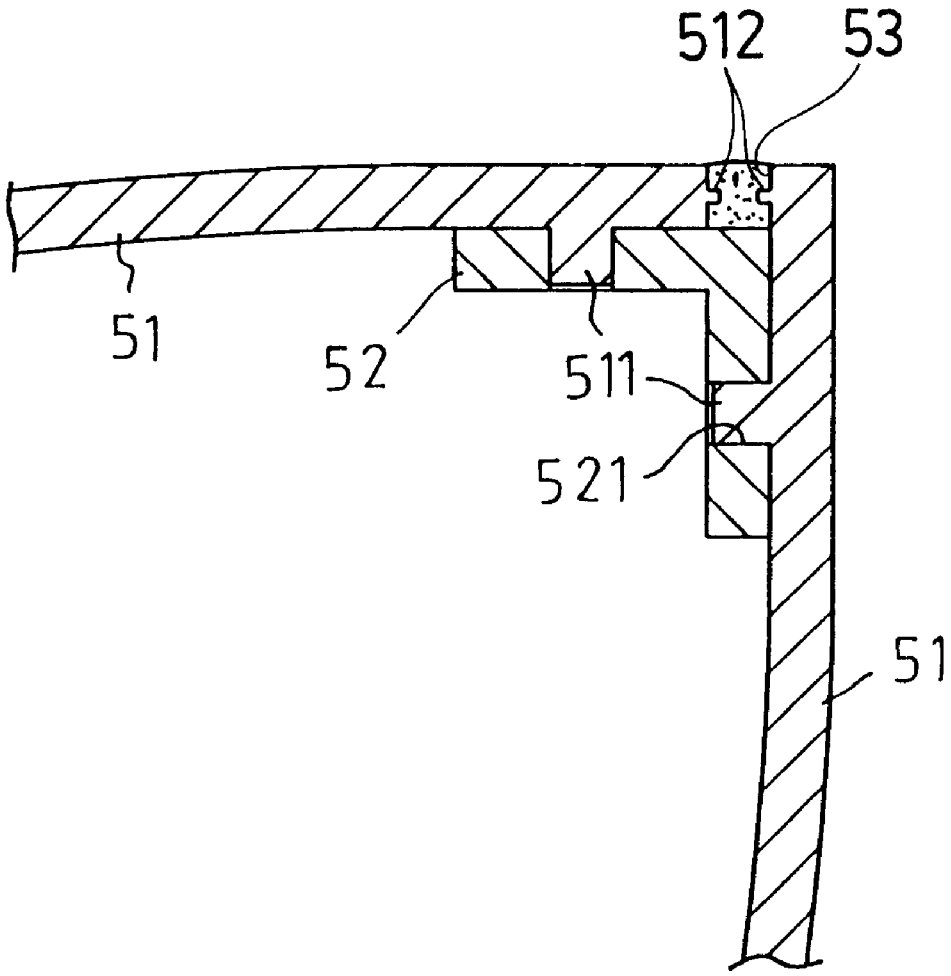
FIG. 8 is an enlarged sectional view of an encircled portion (B) shown in FIG. 7.

Referring to FIGS. 7 and 8, a club head 5 is made via a second preferred embodiment of the method according to the present invention. In this embodiment, the steps for producing the club head 5 are generally similar to those of the first preferred embodiment. A plurality of face plates 51 are initially positioned on a skeleton 52. The skeleton 52 has a plurality of apertures 521 formed therein. Each of the face plates 51 has a plurality of pillars 511 that can engage correspondingly the apertures 521. A plurality of grooves 53 are defined by the adjoining edges of the face plates 51 and the skeleton 52. The skeleton 52 underlies and positions the face plates 51 at the adjoining edges of the face plates 51, and spans the grooves 53 at an inner surface of the golf club head 5. Opposed ribs 512 are formed on the adjoining edges of the face plates 51 and extend into the grooves 53. Therefore, the opposed ribs 512 can engage the solder 56 that is cast in the grooves 53 to enhance the engaging strength of the solder 56 and the face plates 51.

Figure 9:
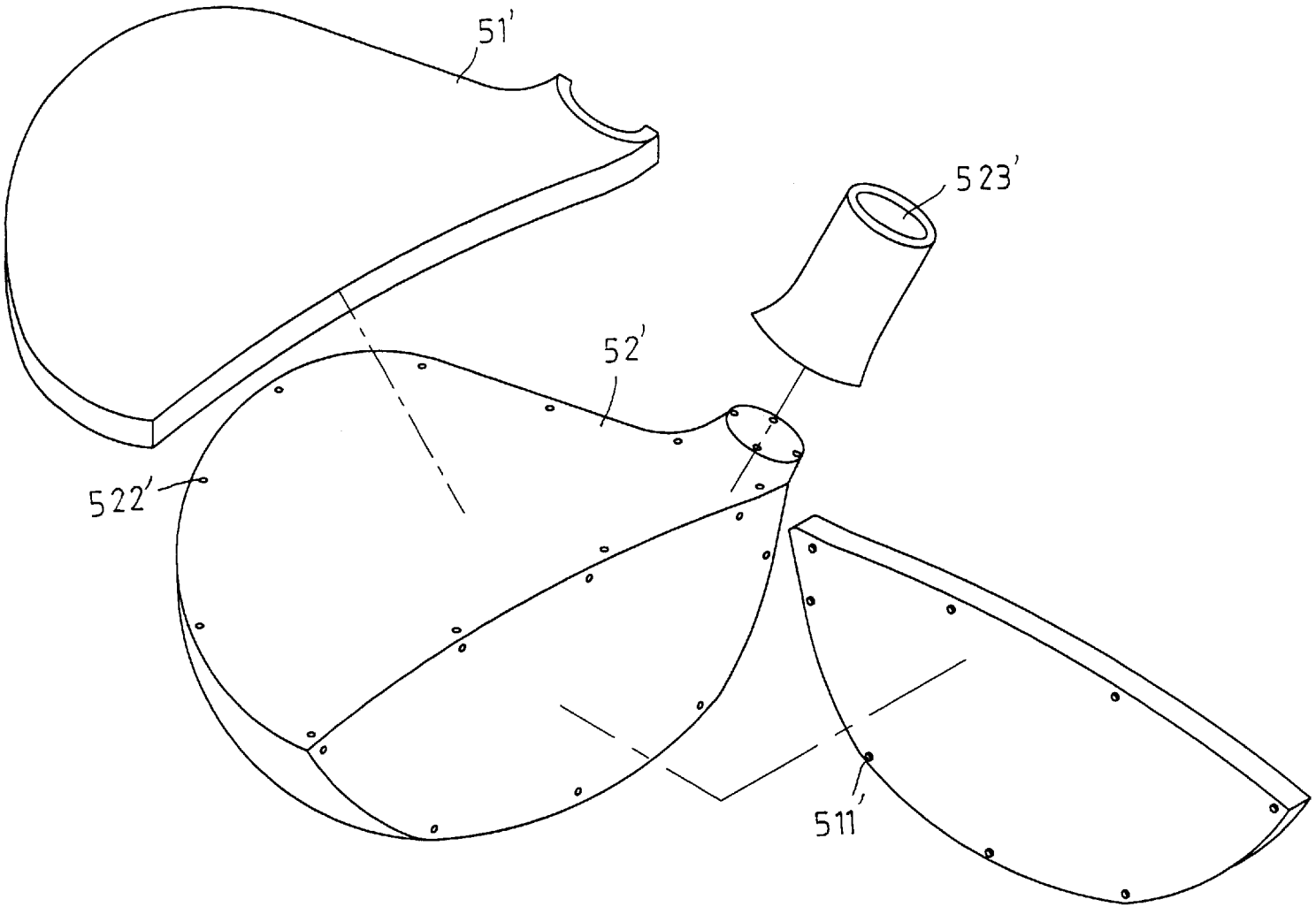
FIG. 9 is an exploded view of another golf club head produced via the second preferred embodiment of the method of the present invention.

FIG. 9 shows a modified golf club head that is made via the second preferred embodiment of the method according to the present invention. In this embodiment, a plurality of face plates 51' are positioned on a solid skeleton 52'. The skeleton 52' has a plurality of apertures 522' that engage correspondingly pillars 511' formed on the face plates 51' to underlie and position the face plates 51'. In addition, the solid skeleton 52' are made of a metal having a melting point lower than that of the solder used to join the face plates 51'. As such, the solid skeleton 52' can be removed by melting the solid skeleton 52' at a temperature lower than the melting point of the solder and by casting the melted skeleton 52' to flow out of the golf club head through an opening 523' formed in a top portion of the golf club head after the face plates 51' are welded together.

Figure 10:
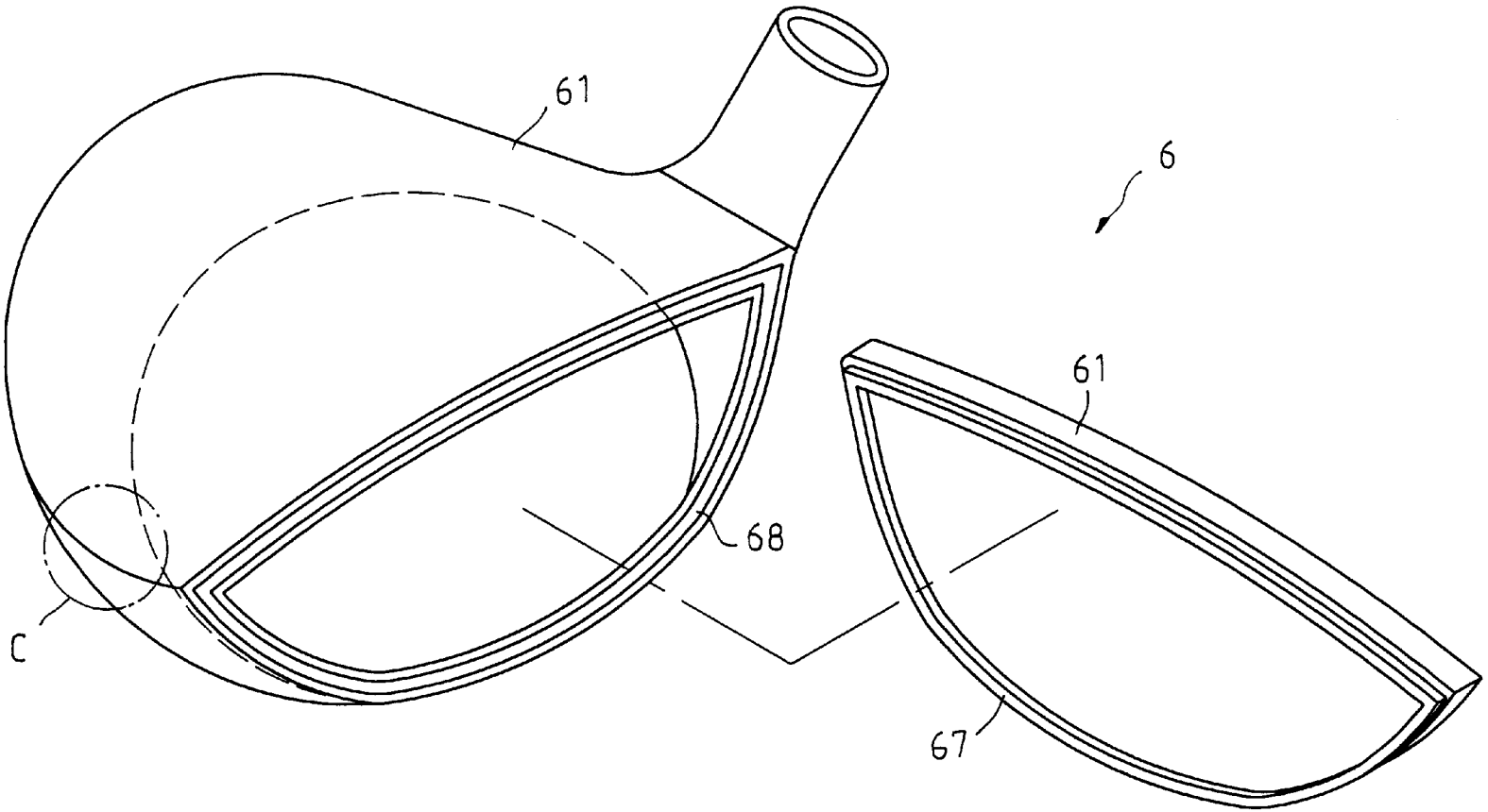
FIG. 10 is an exploded view illustrating a golf club head produced via a third preferred embodiment of the method of the present invention.
Figure 11:
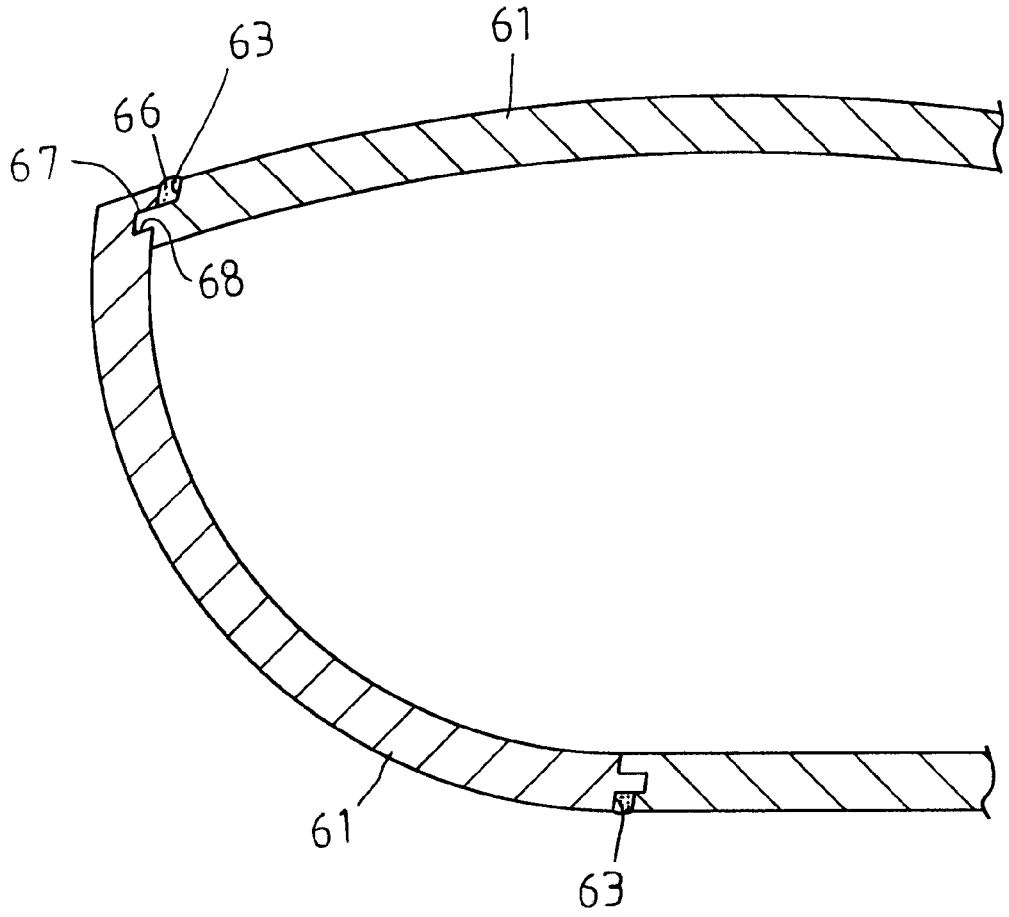
FIG. 11 is an enlarged sectional view of an encircled portion (C) shown in FIG. 10.

Referring to FIGS. 10 and 11, a club head 6 is made via a third preferred embodiment of the method according to the present invention. In this embodiment, the steps for producing the club head 6 are generally similar to those of the first preferred embodiment. However, the adjoining edges of the face plates 61 are formed respectively with inserts 67 and channels 68 that are connectable fittingly to one another to join the face plates 61. Grooves 63 are formed between the adjoining edges of the face plates 61 and are filled with solder 66 to weld the face plates 61 together.

Figure 12:
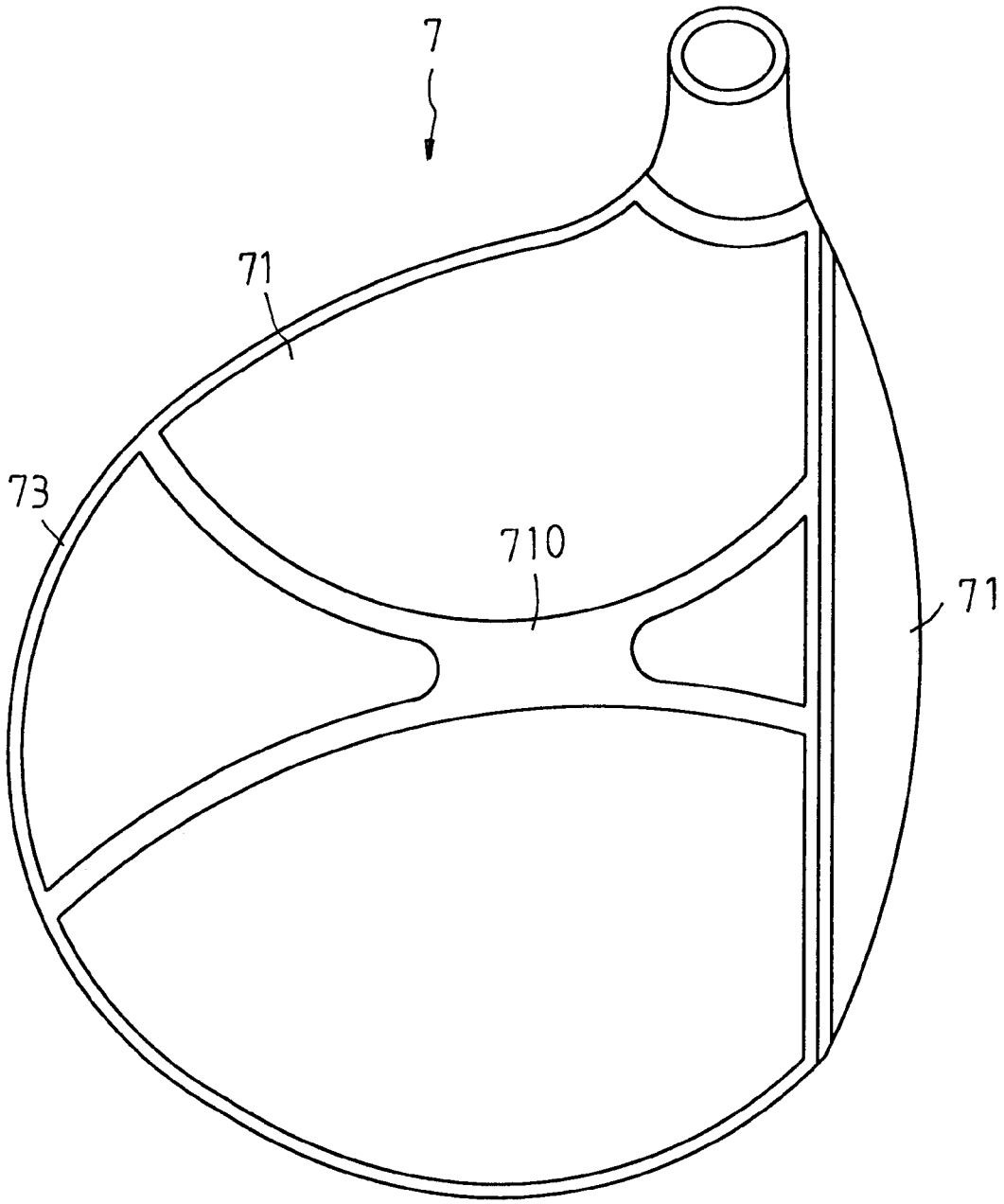
FIG. 12 is a perspective view illustrating a golf club head produced via a fourth preferred embodiment of the method of the present invention.
Figure 13:
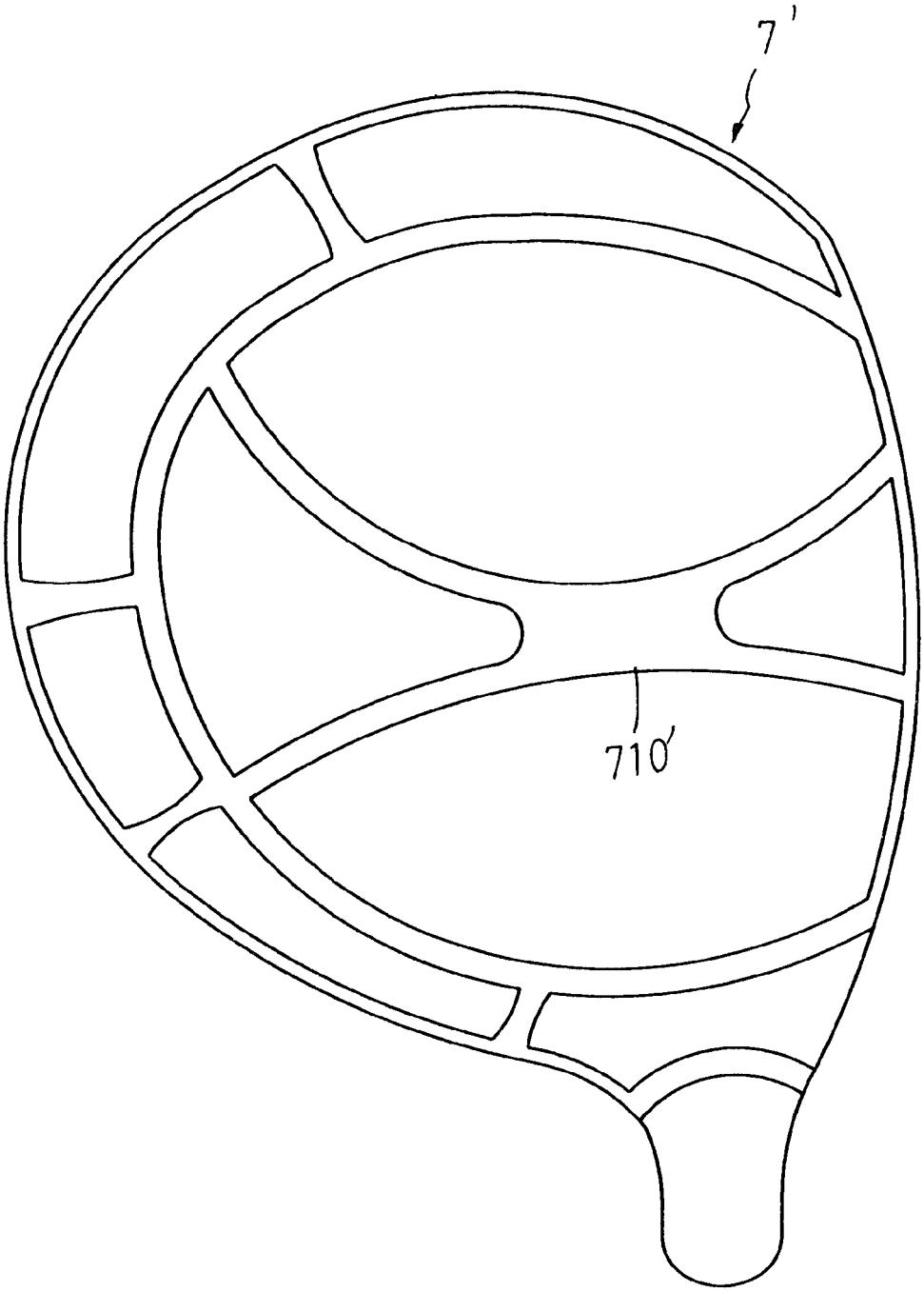
FIG. 13 is a perspective view illustrating another golf club head produced via the fourth preferred embodiment of the method of the present invention.

Referring to FIG. 12, a club head 7 is made via a fourth preferred embodiment of the method according to the present invention. In this embodiment, the steps for producing the club head 7 are similar to those of the third preferred embodiment. However, a plurality of reinforcement flutes 710 are formed in the outer surfaces of the face plates 71 and communicate the grooves 73. The reinforcement flutes 710 may be filled with a solder, such as copper, titanium, and aluminum solder, when the solder fills the grooves 73 to join the face plates 71. As such, the outer surface of the golf club head 7 can have different colors attributed to the different metal materials of the face plates 71 and the solder, thereby improving the appearance thereof. Also, the varied patterns of the reinforcement flutes 710 can improve the appearance of the golf club head 7. FIG. 13 shows a golf club head 7' having reinforcement flutes 710' of a different pattern formed on an outer surface thereof.

The advantages of the method for producing a golf club head according to the present invention are as follows:

1. The solder can quickly fill the grooves in a press-casting mold to join face plates of the golf club head. The golf club head can thus be manufactured at a relatively high speed.

2. The material of the solder can be different from that of the face plates. Therefore, a variety of solders is available for use in welding together the face plates.

3. The appearance of the golf club head can be improved by casting a solder material with a color different from that of the face plates in the grooves in the golf club head. In addition, the pattern of the reinforcement flutes can be varied to further improve the appearance of the golf club head.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A method for producing a golf club head, comprising:

(a) preparing a plurality of face plates that complement with one another to form said golf club head;

(b) joining edges of said face plates to form a shape of said golf club head and providing grooves which extend between adjoining edges of said face plates and which open at an outer surface of said golf club head; and (c) welding the adjoining edges by placing said joined face plates in a mold and by introducing a solder into said mold for casting in said grooves.

2. The method for producing a golf club head as claimed in claim 1, further comprising providing a skeleton to underlie and position said face plates at the adjoining edges and to span said grooves at an inner surface of said golf club head in step (b).

3. The method for producing a golf club head as claimed in claim 2, further comprising providing opposed ribs on the adjoining edges of said face plates in said grooves.

4. The method for producing a golf club head as claimed in claim 1, further comprising providing a skeleton to underlie and position said face plates in step (b), and removing said skeleton by melting said skeleton at a temperature lower than a melting point of said solder and by causing the melted skeleton to flow out of said golf club head after step (c).

5. The method for producing a golf club head as claimed in claim 1, wherein said face plates are joined in step (b) by connecting fittingly interconnecting means provided on the adjoining edges of said face plates.

6. The method for producing a golf club head as claimed in claim 1, further comprising forming a plurality of reinforcement flutes in outer surfaces of said face plates to communicate said grooves, and filling said flutes with said solder in the step of welding the adjoining edges of said face plates.

* * * * *

UNITED STATES PATENT AND TRADEMARK OFFICE

CERTIFICATE OF CORRECTION

PATENT NO. : 6,183,377 B1
DATED : February 6, 2001
INVENTOR(S) : Lung-Cheng Liang It is certified that error appears in the above-identified patent and that said Letters Patent is hereby corrected as shown below:

Title page,
Item [54], change "GOLD CLUB HEAD" to -- GOLF CLUB HEAD --

Column 1,
Line 1, change "GOLD CLUB HEAD" to -- GOLF CLUB HEAD --

Signed and Sealed this

Second Day of October, 2001

*Attest:*

Nicholas P. Godici

*Attesting Officer*

NICHOLAS P. GODICI
*Acting Director of the United States Patent and Trademark Office*